US009341000B2

(12) United States Patent
Van Parys

(10) Patent No.: US 9,341,000 B2
(45) Date of Patent: May 17, 2016

(54) PANIC LOCK

(71) Applicant: Remi Emiel Van Parys, Waregem (BE)

(72) Inventor: Remi Emiel Van Parys, Waregem (BE)

( * ) Notice: Subject to any disclaimer, the term of this patent is extended or adjusted under 35 U.S.C. 154(b) by 331 days.

(21) Appl. No.: 13/887,737

(22) Filed: May 6, 2013

(65) Prior Publication Data

US 2013/0292953 A1 Nov. 7, 2013

(30) Foreign Application Priority Data

May 7, 2012 (BE) ..... 2012/0300

(51) Int. Cl.

| | |
|---|---|
| ***E05C 5/00*** | (2006.01) |
| ***E05B 65/10*** | (2006.01) |
| ***E05C 1/00*** | (2006.01) |
| ***E05C 3/00*** | (2006.01) |
| ***E05B 63/04*** | (2006.01) |
| ***E05B 63/16*** | (2006.01) |
| *E05B 15/00* | (2006.01) |
| *E05B 15/10* | (2006.01) |
| *E05B 17/00* | (2006.01) |
| *E05B 59/00* | (2006.01) |
| *E05B 63/14* | (2006.01) |
| *E05C 1/02* | (2006.01) |
| *E05C 1/08* | (2006.01) |
| *E05C 1/12* | (2006.01) |

(52) U.S. Cl.

CPC ..... *E05B 65/1086* (2013.01); *E05B 63/044* (2013.01); *E05B 63/16* (2013.01); *E05C 1/004* (2013.01); *E05C 3/004* (2013.01); *Y10T 292/0803* (2015.04)

(58) Field of Classification Search

CPC ..... E05B 63/04; E05B 65/1086; E05B 63/16; Y10T 292/82; Y10T 70/5832; Y10T 70/5226; Y10T 292/1014; Y10T 292/57; Y10T 292/0803; E05C 1/004; E05C 3/004

USPC ..... 292/5, 21, 63, 92, 244, 137, 163, 169, 292/173, DIG. 65; 70/107–111, 461, 462

See application file for complete search history.

(56) References Cited

U.S. PATENT DOCUMENTS

| | | | | | |
|---|---|---|---|---|---|
| 87,784 | A | * | 3/1869 | Lysons | 292/244 |
| 88,261 | A | * | 3/1869 | Aston | 292/244 |
| 113,097 | A | * | 3/1871 | Ritter | 292/244 |
| 113,909 | A | * | 4/1871 | Munger | 292/244 |
| 682,975 | A | * | 9/1901 | Day | 70/110 |
| 1,250,997 | A | * | 12/1917 | Eldridge | 70/107 |
| 2,577,216 | A | * | 12/1951 | Spinello | 292/173 |
| 3,589,152 | A | * | 6/1971 | Glass et al. | 70/81 |
| 3,695,068 | A | * | 10/1972 | Eads et al. | 70/107 |
| 3,750,433 | A | * | 8/1973 | Sanders | 70/486 |
| 3,791,180 | A | * | 2/1974 | Doyle | 70/107 |
| 3,993,335 | A | * | 11/1976 | Schmidt | 292/21 |

(Continued)

FOREIGN PATENT DOCUMENTS

| | | | |
|---|---|---|---|
| EP | 1 743 994 | A2 | 1/2007 |
| WO | 2007/082022 | A2 | 7/2007 |
| WO | 2011/009989 | A2 | 1/2011 |

*Primary Examiner* — Kristina Fulton
*Assistant Examiner* — Faria Ahmad
(74) *Attorney, Agent, or Firm* — Sughrue Mion, PLLC

(57) ABSTRACT

A panic lock for building into a door (2) or similar, either as a left lock or a right lock, characterized in that the same lock can be converted to function either as a left lock or a right lock, depending on the desired application, by means of a switching mechanism (29) that is operated by turning the latch bolt (9).

10 Claims, 7 Drawing Sheets

(56) References Cited

U.S. PATENT DOCUMENTS 3,999,789 A * 12/1976 Maurits et al. ..... 292/34
4,192,536 A * 3/1980 Laureano ..... 292/228
4,218,903 A * 8/1980 Eads ..... 70/107
4,243,256 A * 1/1981 Frydrych ..... 292/245
4,257,193 A * 3/1981 Williams ..... 49/465
4,286,812 A * 9/1981 Sprekeler ..... 292/245
4,295,349 A * 10/1981 Wasserfaller ..... 70/111
4,296,956 A * 10/1981 Colombo ..... 292/169.18
4,370,874 A * 2/1983 Munn ..... 70/204
4,463,976 A * 8/1984 Douglas ..... 292/202
4,480,862 A * 11/1984 Fleming ..... 292/162
4,572,556 A * 2/1986 Foshee ..... 292/165
4,583,382 A * 4/1986 Hull ..... E05B 59/00 70/107
4,589,691 A * 5/1986 Foshee et al. ..... 292/165
4,674,776 A * 6/1987 James ..... 292/40
4,695,082 A * 9/1987 Marks ..... 292/169.16
4,726,613 A * 2/1988 Foshee ..... 292/167
4,835,997 A * 6/1989 Akright ..... 70/141
4,854,618 A * 8/1989 Webster ..... 292/244
4,864,835 A * 9/1989 Wartian ..... 70/107
4,932,693 A * 6/1990 Schwartz ..... 292/205
4,934,800 A * 6/1990 Choi ..... 292/172
4,982,986 A * 1/1991 Gressett et al. ..... 292/336.3
4,988,136 A * 1/1991 Gressett, Jr. ..... 292/336.3
4,995,248 A * 2/1991 Liu ..... 70/107
5,072,977 A * 12/1991 Millman et al. ..... 292/336.3
5,077,992 A * 1/1992 Su ..... 70/107
5,085,474 A * 2/1992 Toledo et al. ..... 292/92
5,092,144 A * 3/1992 Fleming et al. ..... 70/95
5,201,200 A * 4/1993 Hauber ..... 70/107
5,403,047 A * 4/1995 Walls ..... 292/173
5,474,348 A * 12/1995 Palmer et al. ..... 292/359
5,495,731 A * 3/1996 Riznik ..... 70/108
5,529,354 A * 6/1996 Studt et al. ..... 292/336.3
5,655,393 A * 8/1997 Kuo et al. ..... 70/107
5,678,870 A * 10/1997 Pelletier ..... 292/244
5,690,372 A * 11/1997 Jans ..... 292/169
5,695,227 A * 12/1997 Smallegan et al. ..... 292/336.3
5,890,385 A * 4/1999 Lee ..... 70/472
6,128,933 A * 10/2000 Mirshafiee et al. ..... 70/107
6,131,966 A * 10/2000 Hensley et al. ..... 292/139
6,282,929 B1 * 9/2001 Eller et al. ..... 70/109
6,349,982 B2 * 2/2002 Fayngersh et al. ..... 292/165
6,443,506 B1 * 9/2002 Su ..... 292/244
6,454,322 B1 * 9/2002 Su ..... 292/244
6,557,909 B2 * 5/2003 Morris ..... 292/169.15
6,578,888 B1 * 6/2003 Fayngersh et al. ..... 292/332
6,584,816 B1 * 7/2003 Lee ..... 70/224
6,651,466 B1 * 11/2003 Shih ..... 70/107
6,662,603 B2 * 12/2003 Morris ..... 70/107
6,978,646 B2 * 12/2005 Raatikainen ..... 70/472
7,108,300 B2 * 9/2006 Hodgin et al. ..... 292/244
7,117,639 B2 * 10/2006 Abdella et al. ..... 49/382
7,152,442 B2 * 12/2006 Char et al. ..... 70/107
7,364,212 B1 * 4/2008 Fan ..... 292/336.3
7,497,486 B1 * 3/2009 Davis et al. ..... 292/32
7,748,759 B2 * 7/2010 Chen et al. ..... 292/347
7,866,713 B2 * 1/2011 Chen ..... 292/244
7,874,189 B2 * 1/2011 Martin ..... 70/85
8,201,858 B1 * 6/2012 Moon et al. ..... 292/164
8,261,584 B2 * 9/2012 Yang ..... 70/107
8,292,336 B2 * 10/2012 Moon ..... 292/61
8,366,158 B2 * 2/2013 Chen ..... 292/244
8,556,304 B2 * 10/2013 Chung et al. ..... 292/137
9,074,391 B2 * 7/2015 Van Parys ..... E05B 65/06
2005/0092040 A1 * 5/2005 Chuang ..... 70/107
2006/0208496 A1 * 9/2006 Kondratuk et al. ..... 292/137
2007/0051143 A1 * 3/2007 Raatikainen et al. ..... 70/107
2007/0114800 A1 * 5/2007 Kuo ..... 292/244
2007/0114801 A1 * 5/2007 Lin ..... 292/336.3
2008/0211239 A1 * 9/2008 Keller ..... 292/164
2008/0246288 A1 * 10/2008 Hodgin et al. ..... 292/244
2010/0052339 A1 * 3/2010 Chen ..... 292/244
2010/0263418 A1 10/2010 Moon
2011/0210566 A1 * 9/2011 Chen ..... 292/244
2011/0283757 A1 * 11/2011 Min ..... 70/462
2013/0291606 A1 * 11/2013 Van Parys ..... 70/111

* cited by examiner

PANIC LOCK

FIELD OF THE INVENTION

The present invention relates to a panic lock, more specifically a panic lock for building into a door or similar.

BACKGROUND OF THE INVENTION

A lock in general and a panic lock in particular are, as known, provided with a latch bolt and a dead bolt and a turnable finger plate for operating the latch bolt and a turnable panic plate for operating the dead bolt, and these finger plates can be operated by means of a key or a handle on the inside and/or outside of the door.

The latch bolt is always provided with a bevel that in an open door is oriented in the direction of the door frame in the door opening, all such that when the door is closed again, the latch bolt is automatically pushed in and goes into the lock.

A panic lock is used in an emergency door for example, whereby in the event of an emergency or panic it must always be specifically possible to open the door from the inside towards the outside by means of a handle, even without a key, while from the outside it is not possible to enter inside by means of a handle on the outside, unless the person has the key or after a specific operation or combination of operations with the handle and/or with the key on the inside.

As with a panic lock the handle on the inside and a handle on the outside must not enable the same operations, it is typical for such panic locks to be equipped with two handle followers that can turn with respect one another, and of which one handle follower is intended to be able to be operated by means of a handle on the inside of the door and the other handle follower is intended to be operated by means of a handle on the outside of the door.

Panic locks are known in two variants, i.e. a panic lock for mounting on the left side of the emergency door, viewed from the inside of the door, and a panic lock for mounting on the right side. Depending on the mounting, the panic lock will have the one side or the other side oriented towards the inside, more specifically towards the space on the side of the door from which a panic opening of the door must be possible.

These variants differ from one another through the bevel of the latch bolt being oriented towards the one or the other side of the panic lock, more specifically towards the side of the panic lock that is intended to be oriented to the inside, and through the handle follower on the one or the other side of the panic lock, more specifically on the side oriented towards the inside, being constructed with the panic functions of an inside handle follower, whereby this inside handle follower is coupled to the finger plates so that it can turn, while the outside handle follower can freely turn with respect to these finger plates, at least insofar the door is not opened with the inside handle follower or the key.

A disadvantage is that both variants must be manufactured and kept in stock.

Furthermore these variants cannot be exchanged, for example in the event of an incorrect order or reuse.

A panic lock is already known from EP 1,743,994 that enables conversion between the two variants, so that the same lock can be used as a left lock or a right lock.

To this end the latch bolt is provided in a holder and can turn through 180° between two positions, whereby the bevel is oriented to the one or the other side of the panic lock.

In addition, for the conversion of the panic lock of EP 1,743,994 a screw is provided that can be moved from one side of the lock to the other side of the lock, in order to turnably couple either the one or the other handle follower, depending on the intended situation, to the finger plates and to uncouple the other handle follower from the turning movement of the finger plates.

A panic lock that enables such a conversion is also known from the Belgian patent application submitted on the same date as the present patent application in the name of the same applicant, whereby in this case the conversion is possible by moving a screw from one position to another position on the same side of the panic lock, such that the conversion is simpler than in the case of EP 1,743,994 and there is also less risk of the said screw getting lost during fitting.

However, a disadvantage remains that a screw must be screwed in and out, whereby it is not excluded that during this operation the screw is lost or falls into the lock case, which requires the lock to be dismantled in order to recover the screw and to prevent blocking of the lock.

Another disadvantage is that a mistake while fitting the screw in the one or other position is always possible and that, when this is not noticed, the panic lock will operate incorrectly and the door will always open from the outside and not from the inside, which is of course an undesired situation as flight is then impossible from the inside of the door in an emergency situation, and undesired access to the building from the outside is provided to anybody.

If the mistake is noticed when testing the dead bolt after assembly, then in any case the panic lock must be taken off the door to rectify the mistake and then be fitted again.

SUMMARY OF THE INVENTION

The purpose of the present invention is to provide a solution to the aforementioned and other disadvantages.

To this end the invention concerns a panic lock comprising a lock case; a dead bolt and a turnable panic plate to operate the dead bolt; a latch bolt and a turnable finger plate in order to operate the latch bolt, whereby the latch bolt can turn in a holder through 180°, two handle followers that are mounted with bearings so that they can rotate coaxially with respect to one another in the lock case, and which each separately, depending on the intended fitting as a left or right lock, can act as an inside or outside handle follower, whereby according to the invention a selectively switchable coupling with two states that enables, depending on the selected position of the coupling, the one or the other handle follower to be turnably coupled to the panic plate or finger plate, and to uncouple the other handle follower to allow it to freely turn with respect to the panic plate and the finger plate, whereby a switching mechanism is provided between the latch bolt and the aforementioned switchable coupling that is such that, when the latch bolt is turned from the one to the other of the two aforementioned positions of the latch bolt, the position of the coupling is switched from the one to the other position in order to couple the one or the other handle follower to the panic plate or the finger plate.

An advantage of the panic lock according to the invention is that the panic lock can very easily be converted from a left lock to a right lock simply by turning the latch bolt with its bevel in the desired position corresponding to a left or right mounting.

A mistake made upon fitting is immediately clear.

Indeed, the latch bolt only has two workable positions, whereby, when the latch bolt is inadvertently turned into the incorrect position, when closing the door the latch bolt will come against the doorframe with its transverse side instead of its slanting side, such that the door will not automatically fit into the lock without an additional action with a handle or the key being done.

Such a mistake can be rectified very easily by turning the latch bolt around.

BRIEF DESCRIPTION OF THE DRAWINGS

With the intention of better showing the characteristics of the invention, two preferred embodiments of a panic lock according to the invention are described hereinafter by way of an example, without any limiting nature, with reference to the accompanying drawings, wherein.

DETAILED DESCRIPTION OF A PREFERRED EMBODIMENT

Figure 1:
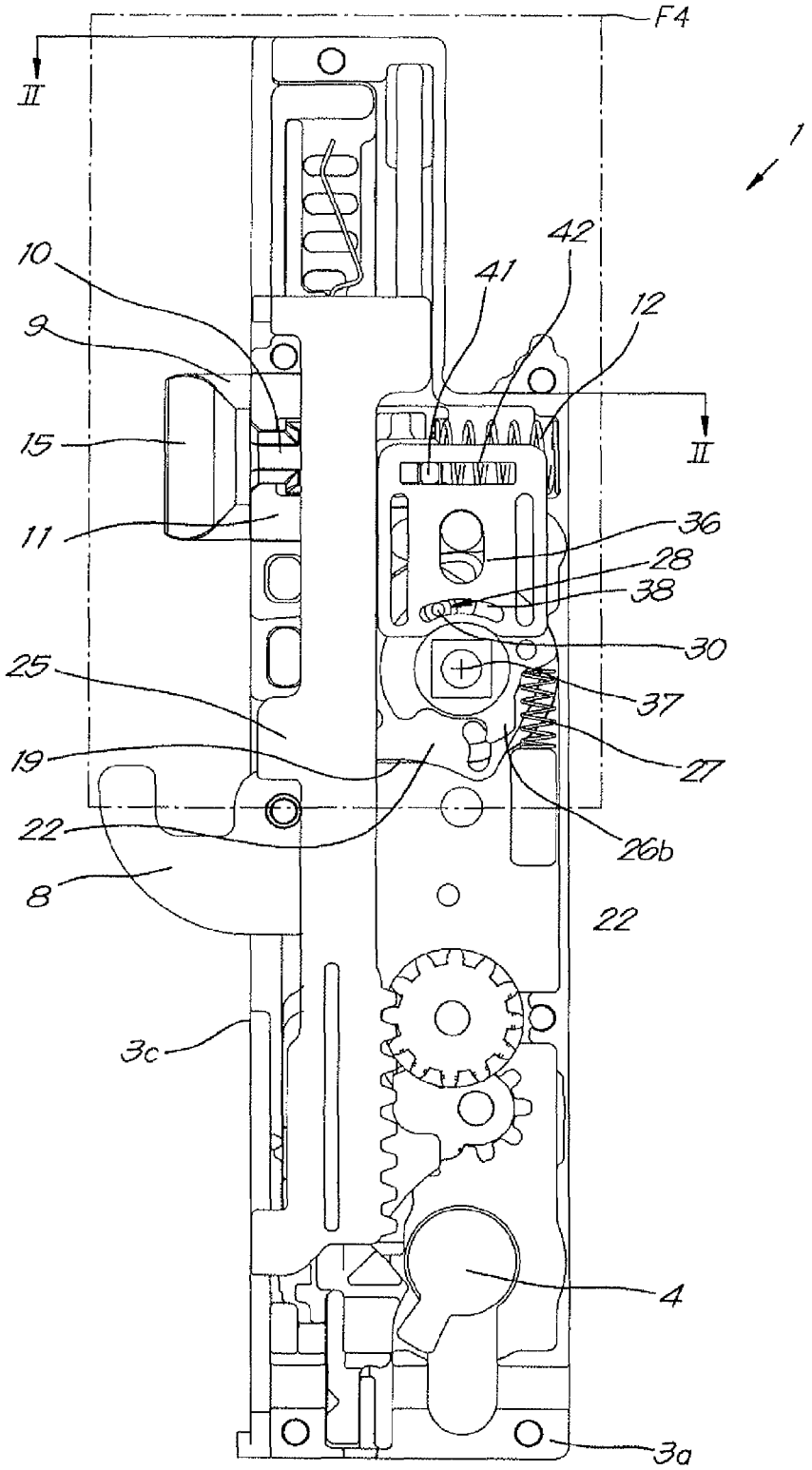
FIG. 1 shows a side view of the mechanism of a first embodiment of a panic lock according to the invention.
Figure 2:
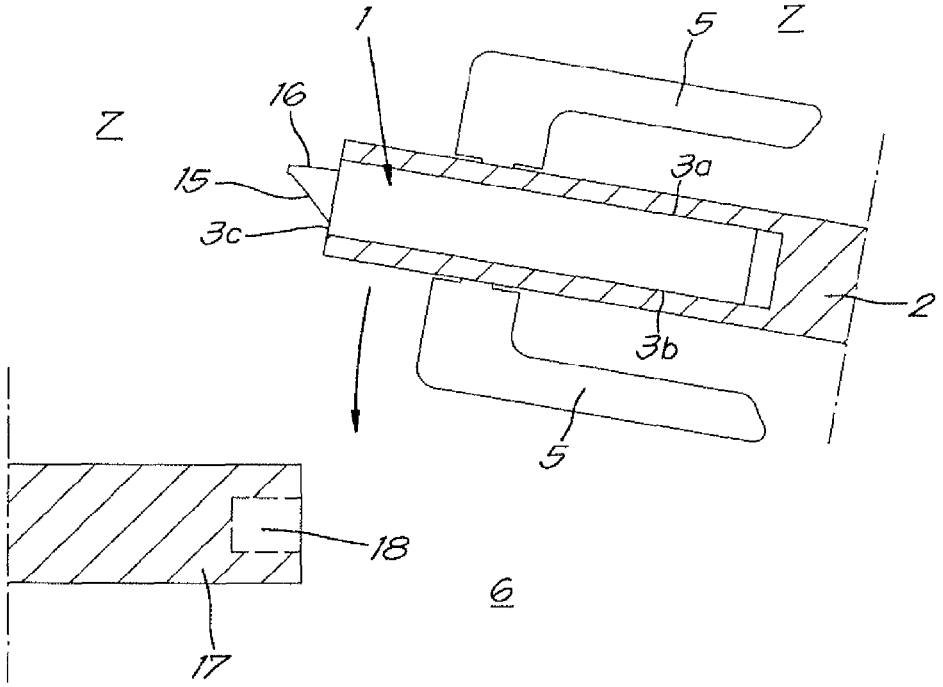
FIG. 2 shows a cross-section according to line II-II of the panic lock of FIG. 1, but built into a door as a left lock.

The panic lock 1 shown in FIG. 1 is intended to be built into an emergency door 2, as shown in FIG. 2.

The panic lock 1 comprises a lock case 3 with a base 3*a* and a cover 3*b* and a side 3*c*, which upon fitting in the door 2 remains visible on the side edge of the door 2.

The panic lock can be operated by means of a cylinder lock 4 or similar and/or by means of handles 5 on the inside 6 and/or the outside 7 of the door 2.

Figure 3:
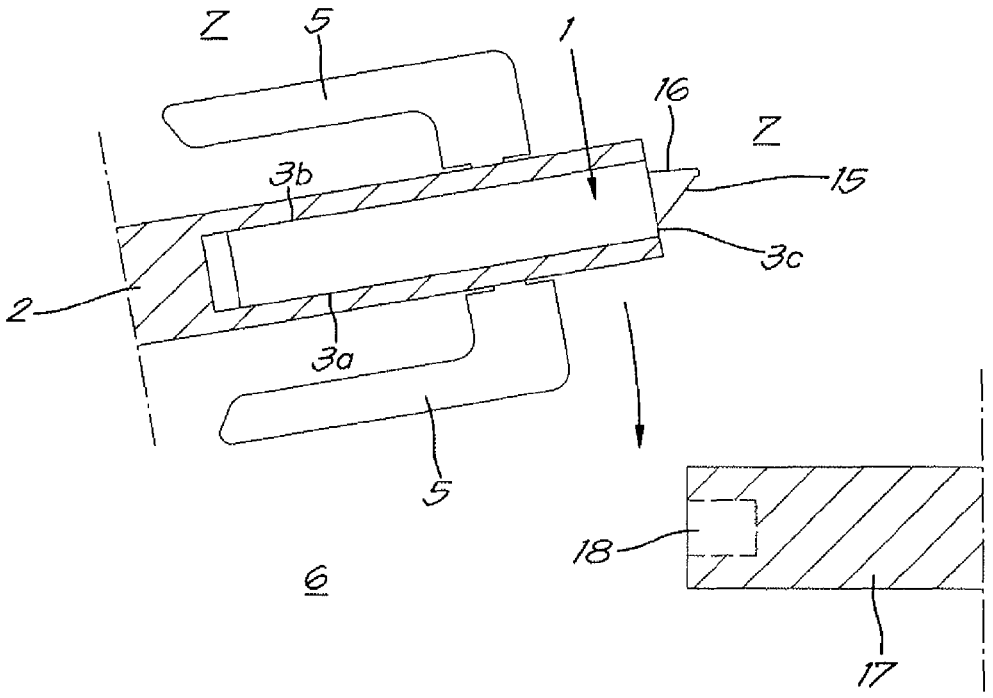
FIG. 3 shows a cross-section analogous to that of FIG. 2, but with the panic lock of FIG. 1 built in as a right lock.

The panic lock 1 can, depending on the situation, either be mounted with the cover 3*b* oriented towards the inside 6 as a left lock in an outward opening door, as shown in FIG. 2, or with the cover 3*b* oriented towards the outside 7 as a right lock, as shown in FIG. 3.

The panic lock 1 is further provided with a dead bolt 8 that can be turned in the lock case 3 between a position whereby the dead bolt 8 protrudes partially out of the aforementioned side 3*c* of the lock case 3 in order to lock the door 2 with the dead bolt, as shown in FIG. 1, and a position (not shown) whereby the dead bolt 8 is turned completely into the lock case 3 to be able to open the door.

The panic lock 1 is also provided with a latch bolt 9 that is mounted on bearings in a holder 11 so that it can turn by means of a shaft 10, and this holder 11 is affixed so that it can move between a rest position whereby the latch bolt 9 protrudes partially out of the lock case 3 by means of a spring 12, as shown in FIG. 1, and a retracted position (not shown) in which the latch bolt 9 is retracted in the lock case 3.

The holder 11 of the latch bolt 9 is provided with an end stop 13 with which the holder 11 is pushed against a leaf spring 14 by means of the aforementioned spring 12, all such that at rest the latch bolt 9 still has a short section in the lock case 3, such that the latch bolt 9 is prevented from turning around its shaft 10.

In order to be able to turn the latch bolt 9 manually around its shaft 10, it is sufficient to pull the latch bolt 9 against the force of the leaf spring 14 by a few millimeters from the lock case 3, and, after turning in the desired position, to release the latch bolt 9 again so that it is brought to its retracted rest position by the leaf spring 14, such that further turning is prevented.

The latch bolt 9 is provided with a slanting side or bevel 15 that is oriented obliquely with respect to the direction of movement of the latch bolt or, in other words, obliquely with respect to the side 3*c* of the lock case 3, and a transverse side 16 that is primarily oriented transversely to the aforementioned side 3*c*.

The latch bolt 9 is turned upon mounting so that the bevel 15 in an open door 2 is oriented in the direction of the doorframe 17 in the door opening, all such that, when the door 2 is closed again, the latch bolt 9 is automatically pushed in upon contact with the frame 17 and springs into the lock opening 18 in the frame 17 under the influence of the spring 12 when the latch bolt 9 passes by this opening 18.

To retract the latch bolt 9 against the force of the spring 12, the panic lock 1 is equipped with a finger plate 19 for the latch bolt 9 that is affixed so that it can turn in the lock case 3 and which is provided with a finger 20 that grips in a recess 21 of the holder 11 of the latch bolt 9 and which pulls the latch bolt 9 inwards, for example by turning the handle 5 on the inside 6 of the door 2.

To open and close the dead bolt 8 a panic plate 22 is also provided that is affixed so that it can turn coaxially with the finger plate 19 of the latch bolt 9 in the lock case 3 and which is provided with a finger 23, which upon turning by a handle 5 on the inside 6, can engage with an end stop 24 of an operating bar 25 that is affixed so that it can turn in the lock case 3 along a direction parallel to the aforementioned side 3*c* of the lock case 3.

A movement of the operating bar 25 in the one or the other direction can turn the dead bolt 8 in or out of the lock case 3. The description of the mechanism that enables this, is described in detail in the aforementioned patent application of the same date and from the same applicant, and is also considered as being incorporated in the present application by reference.

Figure 4:
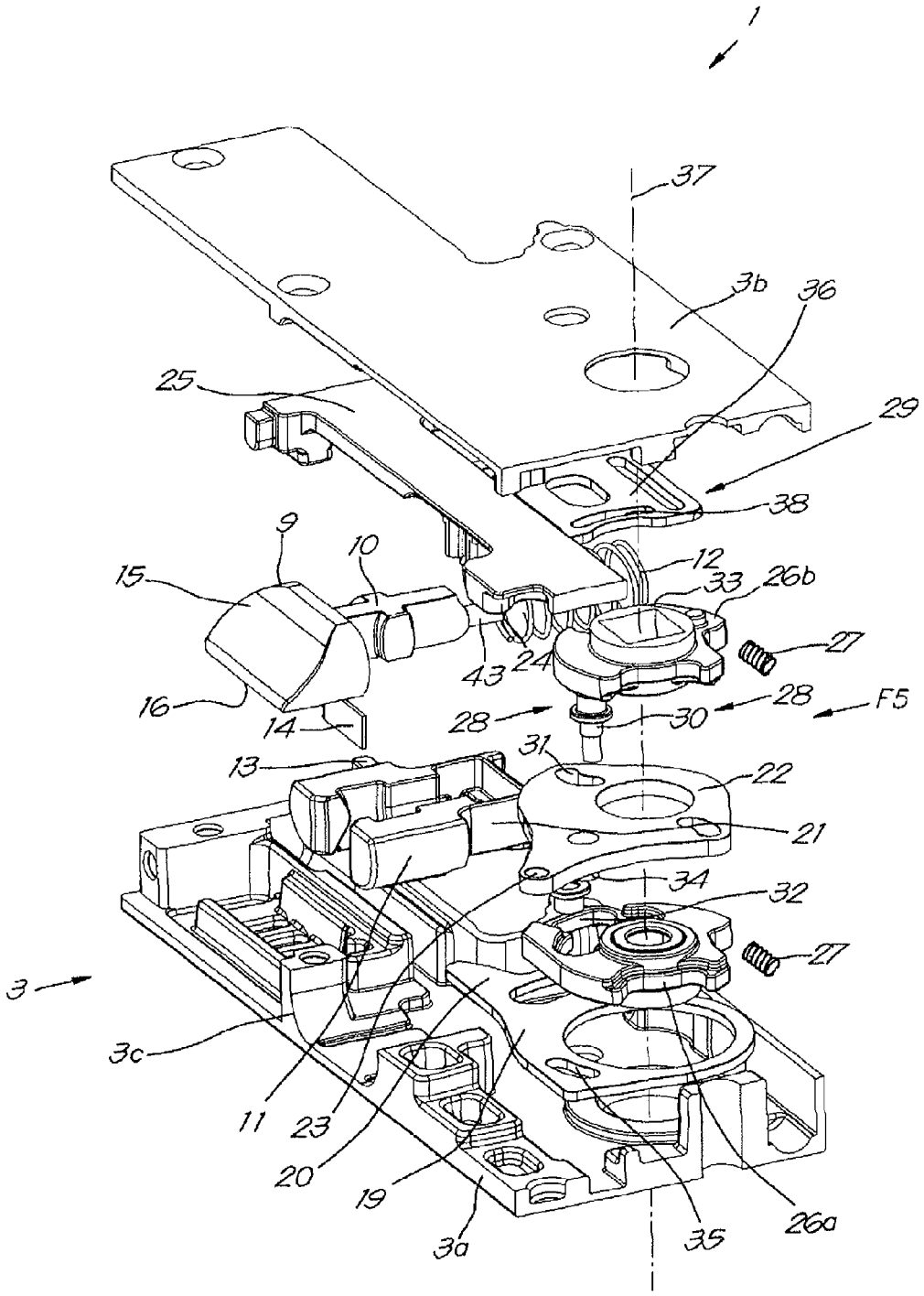
Figure 5:
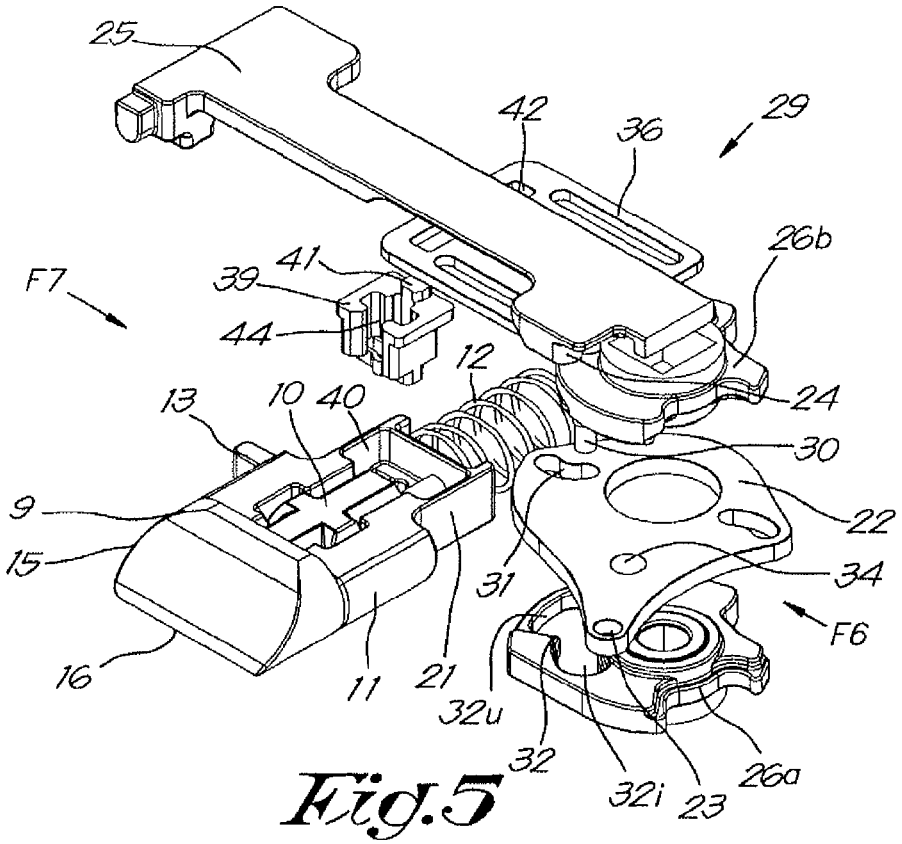
FIGS. 5 to 7 show another perspective view of the parts that are indicated in FIGS. 4 and 5 by F5, F6 and F6 respectively.
Figure 6:
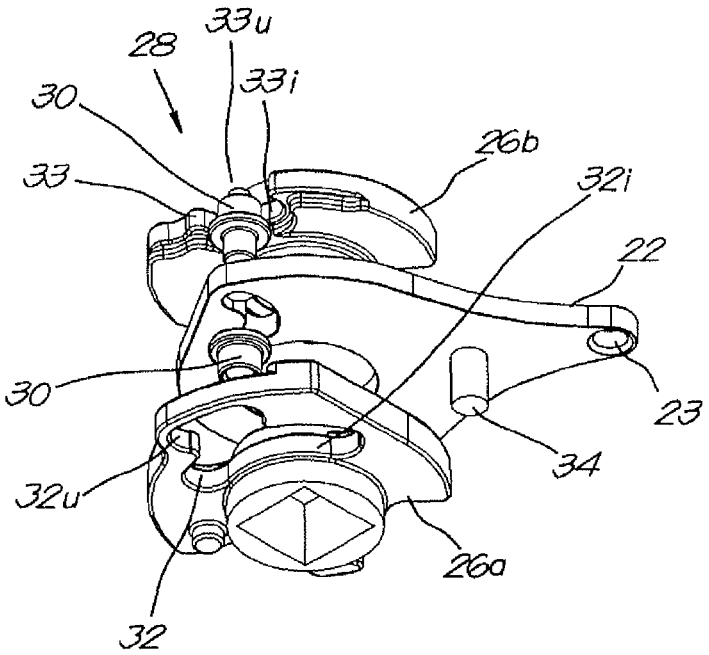
Figure 7:
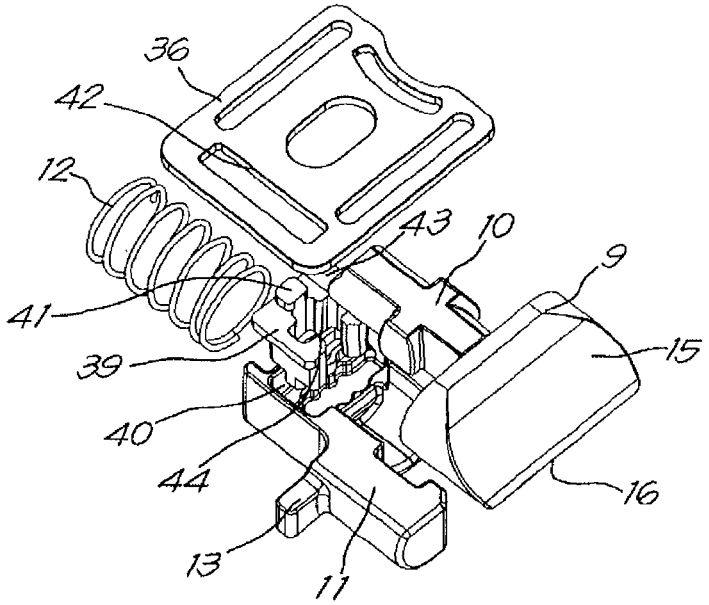

For the operation of the finger plate 19 and the panic plate 22 two handle followers are provided, respectively one handle follower for an operation by means of a handle 5 on the inside 6 of the door 2 and one handle follower for an operation by means of a handle 5 on the outside 7 of the door 2 according to FIG. 4.

These two handle followers 26 are mounted on bearings so that they can turn coaxially with respect one another in the lock case 3 and are each held separately by means of a spring 27 in a rest position, as shown in the drawings.

The handle followers 26 can each act separately as an inside or outside handle follower 26 depending on the intended installation as a left or right lock.

In the event of a left installation, as shown in FIG. 2, the handle follower 26*b* on the side of the cover 3*b* acts as an inside handle follower 26 and the handle follower 26*a* on the side of the base 3*a* acts as an outside handle follower 26, while for a right installation, as shown in FIG. 3, the situation is reversed, whereby the handle follower 26*a* on the side of the base 3*a* takes over the role of the inside handle follower 26 and the other handle follower 26*b* on the side of the cover 3 is the outside handle follower 26.

Irrespective of its use as a left or right lock, the inside handle follower 26 must always be coupled, so that it can turn, to the finger plate 19 and the panic plate 22 of the latch bolt 9 and the dead bolt 8, in order to be able to retract both the dead bolt 8 and the latch bolt 9 with the handle 5 on the inside 6 from the inside 6 of the door 2 in the event of an emergency situation in order to be able to escape to the outside at all times.

According to the invention the panic lock 1 is provided with a selectively switchable coupling 28 with two positions that enable, depending on the selected position of the coupling 28, the one or the other handle follower 26 to be coupled so that it can turn with the finger plate 19 and the panic plate 22, at least the finger plate over a certain angle, and the other handle follower 26 to be uncoupled in order to let it freely turn with respect to the finger plate 19 and the panic plate 22, whereby a switching mechanism 29 is provided between the latch bolt 9 and the aforementioned switchable coupling 28 in order to switch over the coupling 28 to the one or the other handle follower 26 by turning the latch bolt 9 through 180°.

The aforementioned switchable coupling 28 is provided with a coupling element 30 that is held so that it can move in a radial direction in a guide 31 of the panic plate 22, and which extends up to a recess 32, 33 respectively in each of the handle followers 26.

The recesses 32 and 33 have two sections 32*i* and 32*u*, respectively 33*i* and 33*u*, in which the coupling element 30 can be held, whereby these sections merge into one another in a radial direction, and whereby one section 32*i*, respectively 33*u*, extends over a longer distance in the turning direction of the handle follower 26 than the other section 32*u*, respectively 33*i*.

In the handle follower 26*b* on the side of the cover 3*b* the recess 33 has a shape whereby it extends in the most outward located section 33*u* of the recess 33 in the radial direction over a longer distance in the turning direction of the handle follower 26*b* than the most radially inward located section 33*i*, while in the handle follower 26*a* on the side of the base 3*a* it is the very reverse, i.e. it extends to the most inward located section 32*i* in the radial direction of the recess 32 over a longer distance in this turning direction than the most outward located section 32*u*.

The coupling element 30 can be moved in a radial direction between two positions, respectively a position in which the coupling element 30 extends in each of the two handle followers 26 up to the most radially outward located section 32*u*-33*u* of the aforementioned recesses 32-33 in the handle followers 26 concerned, and another position whereby the coupling element 30 extends in each of the two handle followers 26 up to the most radially inward located section 32*i*-33*i* of the aforementioned recesses 33-33 in the handle followers 26 concerned.

In the example of FIG. 4 a fixed pin 34 is provided on the panic plate 22 that can freely turn over a certain angle with the panic plate 22 up to against the end of a slot 35 of the finger plate 19 and which then makes the finger plate 19 of the latch bolt 9 turn with the panic plate 22 of the dead bolt 8 and thus also with the handle follower 26 that is coupled to this panic plate 22 at that time.

The aforementioned switching mechanism 29 between the coupling element 30 and the latch bolt 9 comprises a sliding piece 36 that can move in the lock case 3 in a direction parallel to the side 3*c* of the lock case 3, more specifically in a radial direction with respect to the axis of rotation 37 of the handle followers 26, and which is provided with an arched guide 38 in which the head of the coupling element 30 is affixed so that it can move and which enables a turning movement of the coupling element 30 around the axis of rotation 37 of the handle followers 26.

The switching mechanism 29 further comprises a slide 39 that can move in a guide 40 in the holder 11 of the latch bolt 9 along a direction transverse to the direction of movement of the holder 11, more specifically along a direction parallel to the movement direction of the sliding piece 36.

The aforementioned slide 39 is provided with a pin 41 that is guided movably in a guide 42 of the sliding piece 36 that extends parallel to the direction of movement of the holder 11 of the latch bolt 9 in the lock case 3.

The shaft 10 of the latch bolt 9 is provided on its head end with an eccentrically affixed pin 43 that extends up to a recess 44 of the slide 39 in the holder 11, all such that a turn of the latch bolt 9 through 180° causes a movement of the slide 39 in the holder 11.

The operation of the switchable coupling 30 and the switching mechanism 29 is as follows.

FIG. 1 shows the situation in which the latch bolt 9 is oriented with its bevel 15 towards the cover 3*b* for mounting the panic lock 1 as a left lock as shown in FIG. 2. In this case the handle follower 26*b* on the side of the cover 3*b* acts as an inside handle follower, and the handle follower 26*a* on the side of the base 3*a* is the outside handle follower 26.

In this configuration the slide 39 and the sliding piece 36 are in their most downward position whereby the coupling element 30 is in its most radially inward position.

In this configuration the coupling element 30 is in the most radially located sections 32*i* and 33*i* of the recesses 32 and 33 in the handle followers 26.

In this case a turn of the inside handle follower 26 will carry along the panic plate 22 of the dead bolt in the turning movement by the mutual coupling with the coupling element 30, which in that case is in the most radially inward shortest section 33*i* of the recess 33 in this inside handle follower 26*b*.

As of a certain angular displacement of the inside handle follower 26*b* together with the panic plate 22 of the dead bolt 8, the finger plate 19 of the latch bolt 9 is carried along in the turning movement by the fixed pin 34 on the panic plate 22 against the end of the slot 35 in the finger plate 19 of the latch bolt 9.

This thus makes it possible to unlock both the dead bolt 8, and the latch bolt 9 from the inside and thus to escape to the outside in the event of panic.

A turn of the outside handle follower 26*a* on the other hand has no effect in this situation as the coupling element 30 is held in the most radially inward longest section 32*i* of the recess 32 in which the coupling element 30 can freely move in a relative rotation movement with respect to the outside handle follower 26*a*.

This means that in this case it is not possible to gain access from the outside 7 with the handle 5 without an additional action, for example with a key to turn the cylinder lock 4 or by an action with the inside handle 5.

If the panic lock 1 of FIG. 1 is to be used for installation as a right lock as shown in FIG. 3, then it is sufficient to pull the latch bolt 9 a few millimeters to the outside and then to turn the latch bolt 9 180° and release it in order to let the latch bolt 9 adopt its rest position.

The function of the handle followers 26 is then changed over whereby the handle follower 26*a* on the side of the base 3*a* is now the innermost handle follower 26 and handle follower 26*b* on the side of the cover 3*b* is the outside handle follower 26.

Figure 8:
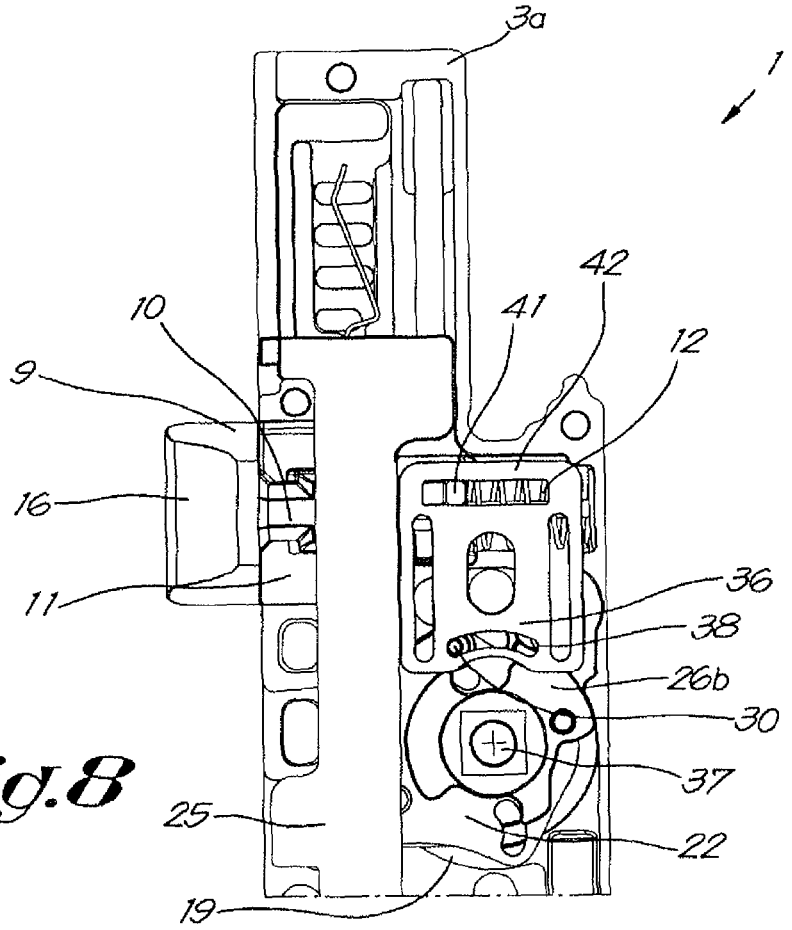
FIG. 8 shows the part that is indicated in FIG. 1 by F4, but in a different position.

By turning the latch bolt 9 the sliding piece 36 moves, carried along by the pin 41 of the slide 39 in the holder 11, upwards from the position of FIG. 1 to the position of FIG. 8.

As a result the coupling element 30 is moved in the radial direction to the most radially outward position whereby the coupling element 30 is moved to the most radially outward shortest section 32*u* of the recess 32 in the inside handle follower 26*a* and to the most radially outward longest section 33*u* of the recess 33 in the outside handle follower 26*b*.

As a result in this case the inside handle follower 26*a* is coupled in the turning direction to the panic plate 22 of the dead bolt 8 and indirectly via the fixed pin 34 on the panic plate 22 in the slot 35 and also to the finger plate 19 of the latch bolt 9, while the outside handle follower 26*b* can turn freely because the coupling element 30 can move freely in the most radially outward longest section 33*u* of the recess 33 of the outside handle follower 26*b*.

Thus also with an installation as a right lock it remains possible to always escape from the inside to the outside, but it is not possible to open the emergency door from the outside.

It is clear that a panic lock 1 according to the invention can be converted very easily from a lock for a left installation to a lock for a right installation, purely by turning the dead bolt 9 half a stroke.

Figure 9:
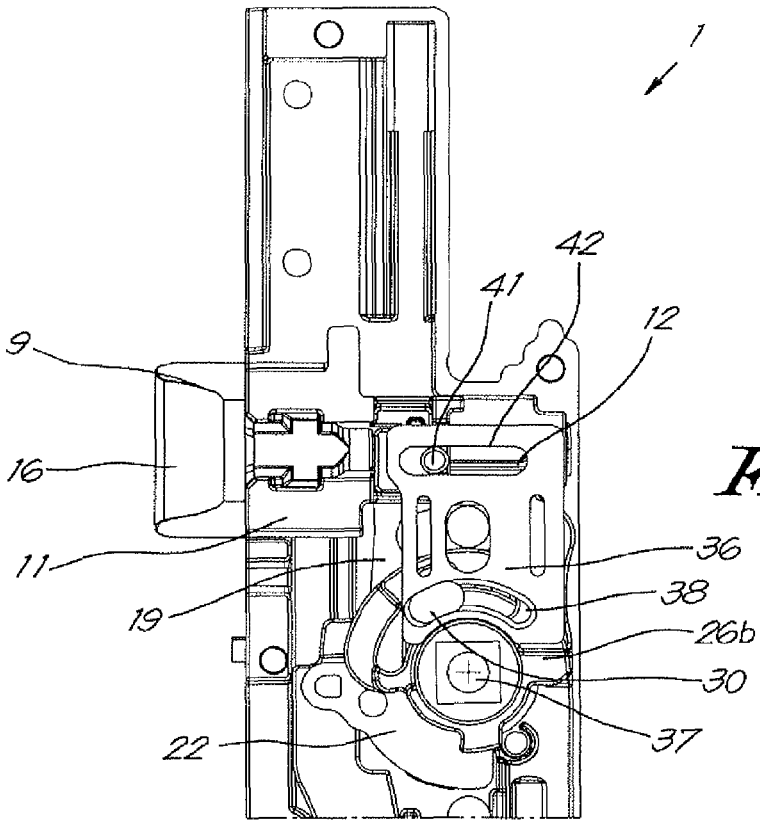
FIG. 9 shows a view such as that of the framed part of FIG. 1, but for an alternative embodiment.
Figure 10:
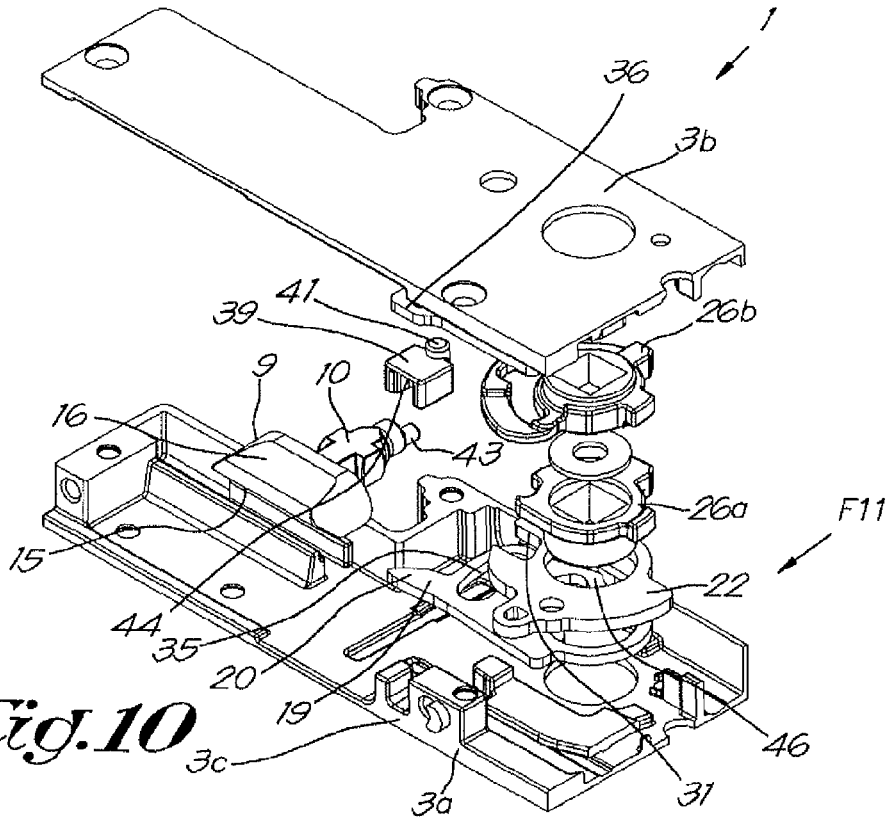
FIG. 10 shows a perspective view such as that of FIG. 4, but for the alternative embodiment of FIG. 9.
Figure 11:
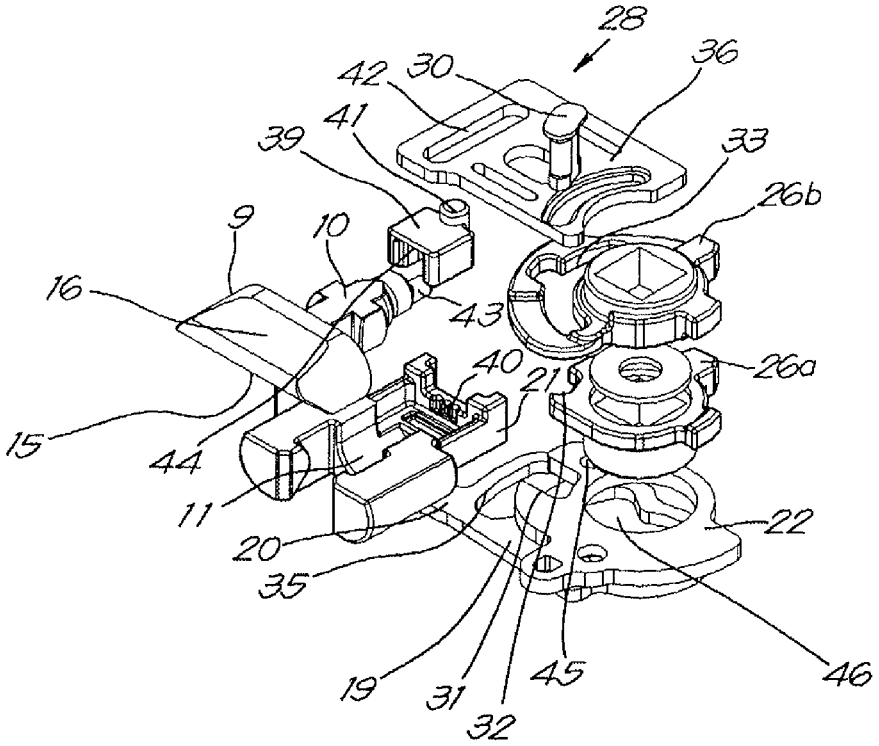
FIG. 11 shows a view of the components that are indicated by F11 in FIG. 10.

FIGS. 9 to 11 show an alternative embodiment of a panic lock 1 according to the invention whereby in this case the coupling element 30 is segment shaped and whereby the finger plate 19 and the panic plate 22 are in this case coupled so that they can turn by means of a fixed pin 45 that is mounted on the panic plate 22 of the dead bolt 8 and which are affixed so that they can turn over an angle in a recess 46 of the finger plate 19 of the latch bolt 9, so that upon a turn of the panic plate 22 of the dead bolt 8 by means of the coupled inside handle follower 26, the finger plate 19 of the latch bolt 9 also turns as of a certain angle.

Corresponding elements of both embodiments are indicated with the same number.

It is clear that the switchable coupling and the switching mechanism can also be realised in different ways whereby the use of tiltable components, in combination or otherwise with slidable components, can be used to bring about a coupling, by turning the latch bolt, between the handle follower that is intended to be turnably coupled as an inside handle follower to one or both finger plates, at least over a part of the angular displacement of the coupled handle follower concerned.

The present invention is by no means limited to the embodiment described as an example and shown in the drawings, but a panic lock 1 according to the invention can be realised in all kinds of variants and in different ways, without departing from the scope of the invention.

The invention claimed is:

1. A panic lock for building into a door or similar, either as a left lock or a right lock, comprising:

a lock case;

a dead bolt and a turnable panic plate to operate the dead bolt;

a latch bolt and a turnable finger plate to operate the latch bolt, whereby the latch bolt can be turned through 180° in a holder between two positions corresponding to an intended installation as a left or right lock respectively;

two handle followers which are mounted in the lock case in a way that they can turn coaxially with respect to one another and which each separately, depending on the intended installation as a left or right lock, can act as an inside or outside handle follower, wherein a selectively switchable coupling is provided with two positions that enables, depending on the selected position of the coupling, the one or the other handle follower to be turnably coupled to the finger plate and the panic plate, and the other handle follower to be uncoupled in order to let it freely turn with respect to the finger plate and to the panic plate, whereby a switching mechanism is provided between the latch bolt and the switchable coupling that is such that, when the latch bolt is turned from the one to the other of the two positions of the latch bolt, the position of the coupling is switched from the one to the other position in order to couple the one or the other handle follower to the finger plate and the panic plate, wherein the switchable coupling is provided with a coupling element that is held so that it can move in the radial direction in a guide of the panic plate and which extends up to a recess of each of the handle followers.

2. The panic lock according to claim 1, wherein the coupling is such that, upon turning the coupled handle follower, the finger plate and the panic plate turn at least through an angle with the coupled handle follower concerned.

3. The panic lock according to claim 1, wherein the latch bolt has a bevel that, depending on the installation as a left or right lock, is turned towards the inside of the door in the one or the other position of the latch bolt, and wherein the switching mechanism is such that, in this position of the latch bolt, the handle follower that is intended to act as the inside handle follower of the two handle followers is coupled to the finger plate and the panic plate.

4. The panic lock according to claim 1, wherein the recess in each handle follower has two sections in which the coupling element can be held, whereby these sections merge into one another in the radial direction and whereby one section extends over a longer distance in the turning direction of the handle follower than the other section.

5. The panic lock according to claim 4, wherein in one of the handle followers the most radially outward located section of the recess extends over a longer distance in the turning direction of the handle follower than the other section, while in the other handle follower the most radially inward located section of the recess extends over a longer distance in this turning direction than the most outward located section.

6. The panic lock according to claim 5, wherein the coupling element can move in the radial direction between two positions, respectively a position whereby the coupling element extends in each of the two handle followers up to the most radially outward located section of the recess in the handle follower concerned, and another position whereby the coupling element extends in each of the two handle followers up to the most radially inward located section of the recess in the handle follower concerned.

7. The panic lock according to claim 1, wherein the switching mechanism comprises a sliding piece that can move in the lock case in a radial direction with respect to the axis of rotation of the handle followers, and which is provided with an arched guide in which the coupling element is affixed so that it can move, and which enables a turning movement of the coupling element around the axis of rotation of the handle followers.

8. The panic lock according to claim 7, wherein the switching mechanism comprises a slide that can move in the holder of the latch bolt along a direction transverse to the direction of movement of the holder and can move in this direction by turning the latch bolt in the holder.

9. The panic lock according to claim 8, wherein the slide in the holder is provided with a pin that is movably guided in a guide of the sliding piece that extends parallel to the direction of movement of the holder of the latch bolt in the lock case.

10. The panic lock according to claim 8, wherein the latch bolt is provided with a pin that is arranged eccentrically with respect to the shaft of the latch bolt and which extends up to a recess of the slide.

* * * * *